US009317054B2

(12) United States Patent
Pons et al.

(10) Patent No.: US 9,317,054 B2
(45) Date of Patent: Apr. 19, 2016

(54) FEEDBACK NETWORK FOR LOW-DROP-OUT GENERATOR

(71) Applicant: STMicroelectronics International N.V., Amsterdam (NL)

(72) Inventors: Alexandre Pons, Vizille (FR); Karel Napravnik, Prague (CZ)

(73) Assignee: STMICROELECTRONICS INTERNATIONAL N.V., Amsterdam (NL)

( * ) Notice: Subject to any disclaimer, the term of this patent is extended or adjusted under 35 U.S.C. 154(b) by 0 days.

(21) Appl. No.: 14/492,877

(22) Filed: Sep. 22, 2014

(65) Prior Publication Data

US 2015/0084609 A1 Mar. 26, 2015

(30) Foreign Application Priority Data

Sep. 24, 2013 (EP) ..... 13306303

(51) Int. Cl.
*G05F 1/00* (2006.01)
*G05F 1/575* (2006.01)

(52) U.S. Cl.
CPC ..... *G05F 1/575* (2013.01)

(58) Field of Classification Search
CPC ..... G05F 1/575
USPC ..... 323/234, 273, 280, 297, 298, 313, 353, 323/354
See application file for complete search history.

(56) References Cited

U.S. PATENT DOCUMENTS

| | | | | |
|---|---|---|---|---|
| 7,619,402 | B1 | 11/2009 | Kwong | |
| 8,847,515 | B2 * | 9/2014 | King et al. | 315/307 |
| 2005/0218980 | A1 * | 10/2005 | Kalb | 330/253 |
| 2007/0296384 | A1 | 12/2007 | Dow et al. | |

FOREIGN PATENT DOCUMENTS

| | | | |
|---|---|---|---|
| DE | 10258763 | B3 | 7/2004 |
| WO | WO-2011010151 | A2 | 1/2011 |

OTHER PUBLICATIONS

EPO Search Report for EP13306303.2 dated Feb. 18, 2014 (4 pages).
UK-IPO Search Report for EP 13306303.2 dated Jan. 19, 2016 (4 pages).

* cited by examiner

*Primary Examiner* — Adolf Berhane
*Assistant Examiner* — Afework Demisse
(74) *Attorney, Agent, or Firm* — Gardere Wynne Sewell LLP

(57) ABSTRACT

A circuit may include a differential amplifier and a feedback network. The feedback network may have a chain of resistance sets coupled in series, with a first end terminal coupled to an output terminal of the differential amplifier and a second end terminal coupled to a power reference terminal of the differential amplifier. Respective nodes may be coupled between successive ones of the resistance sets. A feedback terminal may be coupled to an inverting input terminal of the differential amplifier. A controller may control a set of switches to electrically couple a given node to the feedback terminal. A first resistance set of the chain adjacent the first end terminal may be two resistance subsets coupled in series, with an intermediate node coupled therebetween. A programmable current generator may have a current output coupled to the intermediate node and may produce a controlled current flowing at the current output terminal.

23 Claims, 6 Drawing Sheets

FEEDBACK NETWORK FOR LOW-DROP-OUT GENERATOR

RELATED APPLICATION

This application claims the priority benefit of European Patent Application Number 13306303.2, filed on Sep. 24, 2013, entitled "FEEDBACK NETWORK FOR LOW-DROP-OUT GENERATOR" which is hereby incorporated by reference to the maximum extent allowable by law.

TECHNICAL FIELD

This disclosure relates to a feedback network for a low-drop-out generator.

BACKGROUND

Low-drop-out (LDO) regulators are widely used, and may have programmable output voltages. The output voltage selection for an LDO regulator may be implemented within its feedback network.

FIG. 1 is a circuit diagram of an LDO regulator. Reference number 1000 generally denotes the LDO regulator as a whole, which includes a differential amplifier 100 and a feedback network 200. The electrical couplings of the amplifier 100 are a DC power supply terminal 105, a power reference terminal 104 which may be grounded and is denoted GND, an output terminal 101 which forms the LDO regulator output, an inverting input terminal 102 which is coupled to the output terminal 101 via the feedback network 200, and a non-inverting input terminal 103 which is connected to a reference voltage supply 300. $V_{DD}$ is the DC power supply voltage, $V_{REF}$ is the voltage of the reference voltage supply 300, which may be obtained from the silicon bandgap value, and $V_{FB}$ is the voltage which is supplied by the feedback network 200 to the inverting input terminal 102. Due to the operation of the differential amplifier 100, $V_{FB}$ may equal $V_{REF}$. Then, the output voltage $V_{OUT}$ at the output terminal 101 may be $G*V_{REF}$, where G is the division factor of the feedback network 200, and is greater than unity.

New feedback network designs for use with LDO regulators are desirable.

SUMMARY

A feedback network for a LDO regulator may have the following additional features. The first resistance set of the chain, adjacent its first end terminal, may include two series-coupled resistance subsets with an intermediate node between these two resistance subsets. In addition, the feedback network may also include a first programmable current generator with a current output terminal coupled to the intermediate node between the resistance subsets of the first resistance set of the chain. The first programmable current generator may be suitable for producing a controlled value of a current flowing at its current output terminal.

Thus, the first programmable current generator in combination with the resistance subset closest to the first end terminal of the chain may produce a variable voltage which adds to that produced by the chain of resistance sets itself. Because the first programmable current generator may be independent from the set of switches and the controller dedicated to these switches, the variable voltage generated by the first current generator may add to the output voltage contribution produced by the chain in accordance with the selected one of the chain nodes. This may lead to a total number of available values for the LDO output voltage which is higher, although the number of the resistance sets in the chain may not be increased. This is obtained via the first programmable current generator which is effective with any of the nodes in the chain.

In particular, the number of resistance sets contained in the chain may be reduced when implementing the first programmable current generator, while maintaining the total number of voltage values available for the LDO regulator output as constant.

The resistance sets of the chain may have respective values which are selected so that the voltage of the first end terminal varies with a constant increment upon variation along the chain of the selected node which is electrically coupled to the feedback terminal. The tuning which is provided by the chain of resistance sets for the output voltage of the LDO regulator may thus be simpler than that of conventional approaches.

Advantageously, the first programmable current generator may be adapted so that the current which flows at the current output terminal of this first programmable current generator is digitally controlled. The additional tuning which is provided for the output voltage of the LDO regulator, further to the selection of the coupled node within the chain, may thus be easier. The total number of available values for the LDO regulator output voltage may be equal to the product of the value available for the current output by the first current generator, with the number of node selections provided by the controller.

The last resistance set of the chain adjacent the second chain end terminal may be two other series-coupled resistance subsets with another intermediate node which is arranged between these two other resistance subsets. Then, the feedback network may also include a second programmable current generator with a current output terminal which is coupled to the other intermediate node between the two other resistance subsets of the last resistance set of the chain. This second programmable current generator may be suitable for producing a controlled value of a current flowing at the current output terminal of this second programmable current generator. Thus, third tuning circuitry may be available for adjustment the value of the LDO output voltage.

For easier use of this third tuning, the second programmable current generator may also be adapted so that the current which flows at the current output terminal of this second programmable current generator is digitally controlled.

Advantageously, when both first and second programmable current generators are implemented, these may be oriented so that the current flowing at the current output terminal of one of them is originating from the corresponding intermediate node, and the current flowing at the current output terminal of the other is flowing toward the respectively corresponding intermediate node. Thus, tuning may be available by using both programmable current generators which operate by increasing and decreasing the LDO output voltage with respect to the value as resulting from the chain node selection.

A low-drop-out (LDO) generator is also proposed which includes a reference voltage supply, and a differential amplifier having inverting and non-inverting input terminals and an output terminal, with the non-inverting input terminal being coupled to the reference voltage supply. The LDO generator may also include a feedback network as described before, with the first and second end terminals of the chain being coupled respectively to the output terminal and the power reference terminal of the differential amplifier, and the feedback terminal of the feedback network being to the inverting input terminal of the differential amplifier.

In an application of the LDO regulator, the first programmable current generator may be designed so that a maximum current value which is output by this first programmable current generator, multiplied by the value of the resistance subset between the first chain end terminal and the intermediate node within the first resistance set, is less than a minimum voltage increment obtained for the output terminal of the differential amplifier when varying the selected node which is coupled to the feedback terminal. Thus, the chain of resistance sets together with the switch arrangement and the feedback network controller may provide a coarse tuning of the output voltage of the LDO regulator, and the first programmable current generator may provide a fine tuning of this LDO regulator output voltage.

When the voltage increment due to the node selection within the chain is constant, the first current generator may be designed so that varying a control of this first current generator causes the voltage of the output terminal of the differential amplifier to further vary with a constant secondary increment, with this secondary increment being equal in absolute value to the increment related to the chain node selection, divided by a number of output current values which are available for the first programmable current generator. Thus, the feedback network may provide complete tuning of the LDO output voltage according to the secondary increment.

Finally, an integrated circuit chip, which includes several LDO regulators as described is also proposed. The programmable current generators of the feedback networks of these LDO regulators may contain respective digital-to-analog converters, which are arranged adjacent one another in a chip portion apart from a remaining portion chip which contains remaining circuit parts. In particular, these remaining circuit parts may include the chains of resistance sets of the feedback networks, and also the differential amplifiers of the low-drop-out regulators. Such a chip arrangement may be advantageous since it may not involve re-designing the layout of the remaining chip portion for adding or removing some of the digital-to-analog converters for implementation.

Each one of the first and second programmable current generators may comprise a fixed-current generator for supplying the digital-to-analog converter of this programmable current generator. Then, the fixed-current generator may be shared by several ones of the LDO regulators.

DETAILED DESCRIPTION

Figure 2:
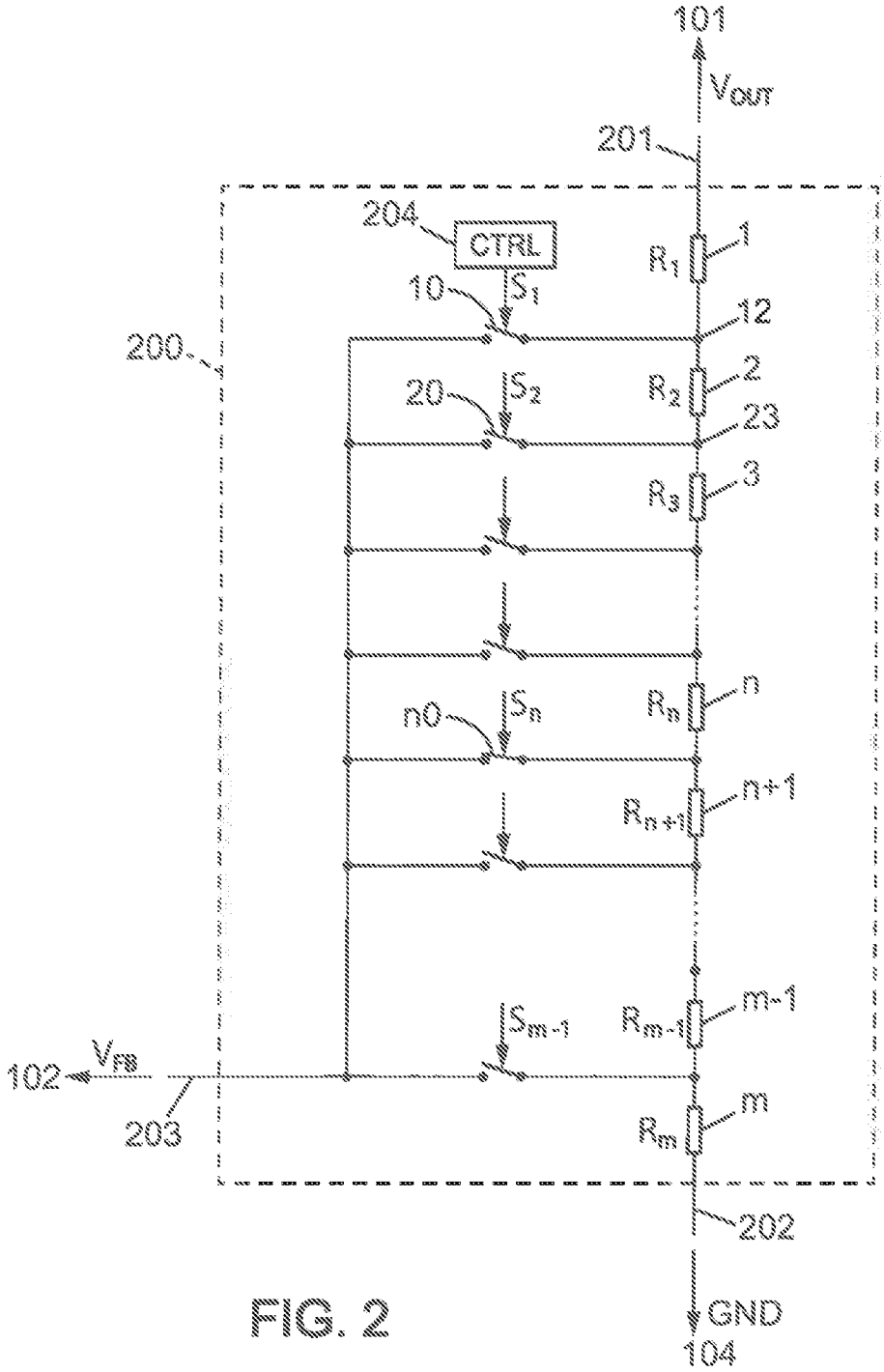
FIG. 2 (PRIOR ART)
FIG. 2 is a circuit diagram of conventional feedback network that is suitable for the LDO regulator of FIG. 1.

With reference to FIG. 2, a sample structure for the feedback network 200 dedicated to a LDO generator may include a chain of series-connected resistance sets 1, 2, . . . , m−1, m with nodes 12, 23, . . . , X each arranged between successive ones of the resistance sets within the chain, and with first and second chain end terminals 201, 202 which are to be coupled respectively to the output terminal and the power reference terminal of the differential amplifier. The feedback network 200 may also include a set of switches 10, 20, . . . , Y which are arranged for electrically coupling a selected one of the chain nodes 12, 23, . . . , X to a feedback terminal 203 of the feedback network 200, with the feedback terminal 203 itself to be coupled to the inverting input terminal of the differential amplifier. The feedback network 200 may also include a controller 204 denoted CTRL, which is arranged for controlling the set of switches 10, 20, . . . , Y so as to electrically couple the selected one of the chain nodes 12, 23, . . . , X to the feedback terminal 203.

$R_1$, $R_2$, . . . , $R_{m-1}$, $R_m$ denote the respective resistance values of the resistance sets 1, 2, . . . , m−1, m of the chain. Each resistance set may include several resistance units arranged to produce the resistance value desired for this resistance set. $S_1, S_2, \ldots, S_{m-1}$ denote the control signals which are supplied by the controller 204 respectively to the switches 10, 20, . . . , Y If the controller 204 is digital, it may be fed at input with a control word $<S_1:S_{m-1}>$, with a word bit-length which is suitable such that the control signals $S_1, S_2, \ldots S_{m-1}$ can be deduced from the value of the control word $<S_1:S_{m-1}>$. In FIG. 2, n is an integer selected from 1 to m−1. As shown, the switch n0, which is located between the feedback terminal 203 and the chain node between the resistance sets n and n+1, is in a coupling state, whereas the other switches are in an isolating state. Then, the division factor of the feedback network 200 is:

$$G = 1 + \frac{\sum_{i=1}^{i=n} R_i}{\sum_{i=n+1}^{i=m} R_i}, \tag{1}$$

with $$V_{OUT} = G \cdot V_{REF}$$

The switch arrangement represented is for illustrative purpose in this disclosure, and other arrangements may be used equivalently for coupling a single one of the nodes 12, 23, . . . , X to the feedback terminal 203. The switch arrangement represented here may be useful because each switch conducts very little current when in the coupling state due to the high input impedance of the amplifier terminal, so that the switches may be small and designed for occupying a reduced silicon substrate area.

For example, the chain may contain m=257 resistance sets, with 256 switches, leading to 256 voltage steps which may have a constant increment value for the output voltage $V_{OUT}$ of the LDO regulator 1000 if the resistance values $R_1$, $R_2$, . . . , $R_m$ are selected appropriately. Then, the controller 204 is to be fed with a 8-bit word for being capable of selecting one of the switches to drive it into the coupling state while maintaining the other switches in the isolating state.

But the feedback network 200 has the certain drawbacks. For example, the feedback network 200 includes a number of resistance sets and switches which is equal to the number of available output voltage values which are desired for the LDO regulator 1000, the number of which may be of interest in new circuit designs. This can result in the silicon substrate area which is occupied by the feedback network being large. In addition, the bit-length of the control word which is supplied to the controller 204 may increase with the desired number of available output voltage values, thereby using a more complex controller design.

Figure 1:
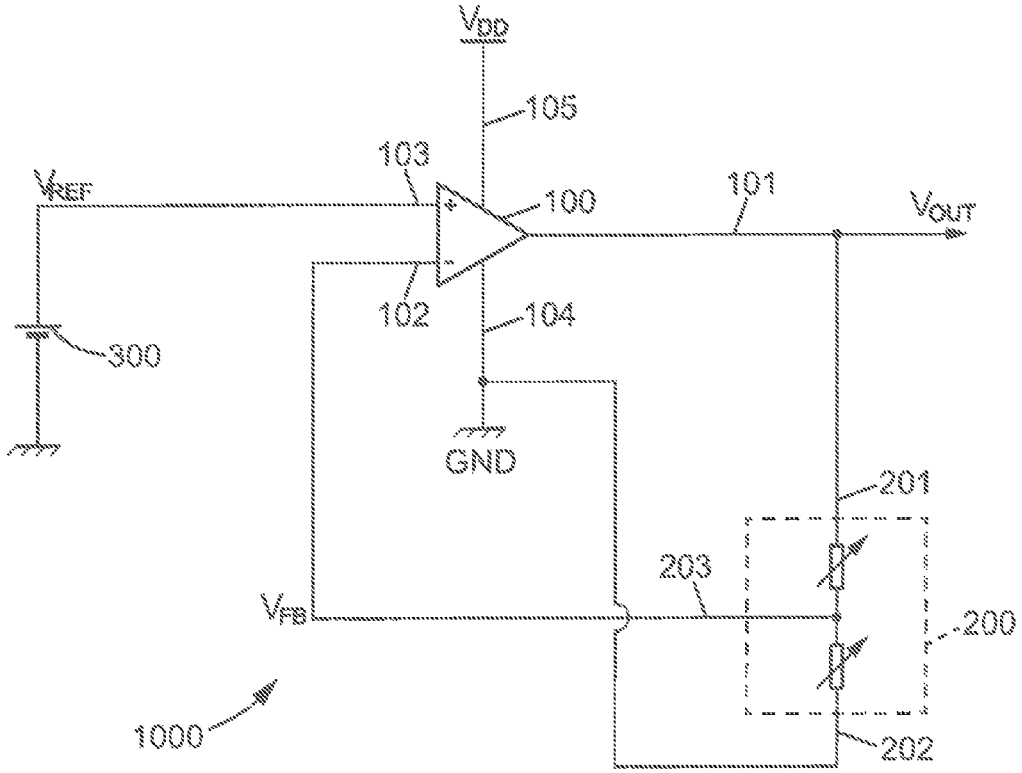
FIG. 1 (PRIOR ART)
FIG. 1 is a circuit diagram of a conventional LDO regulator.
Figure 3:
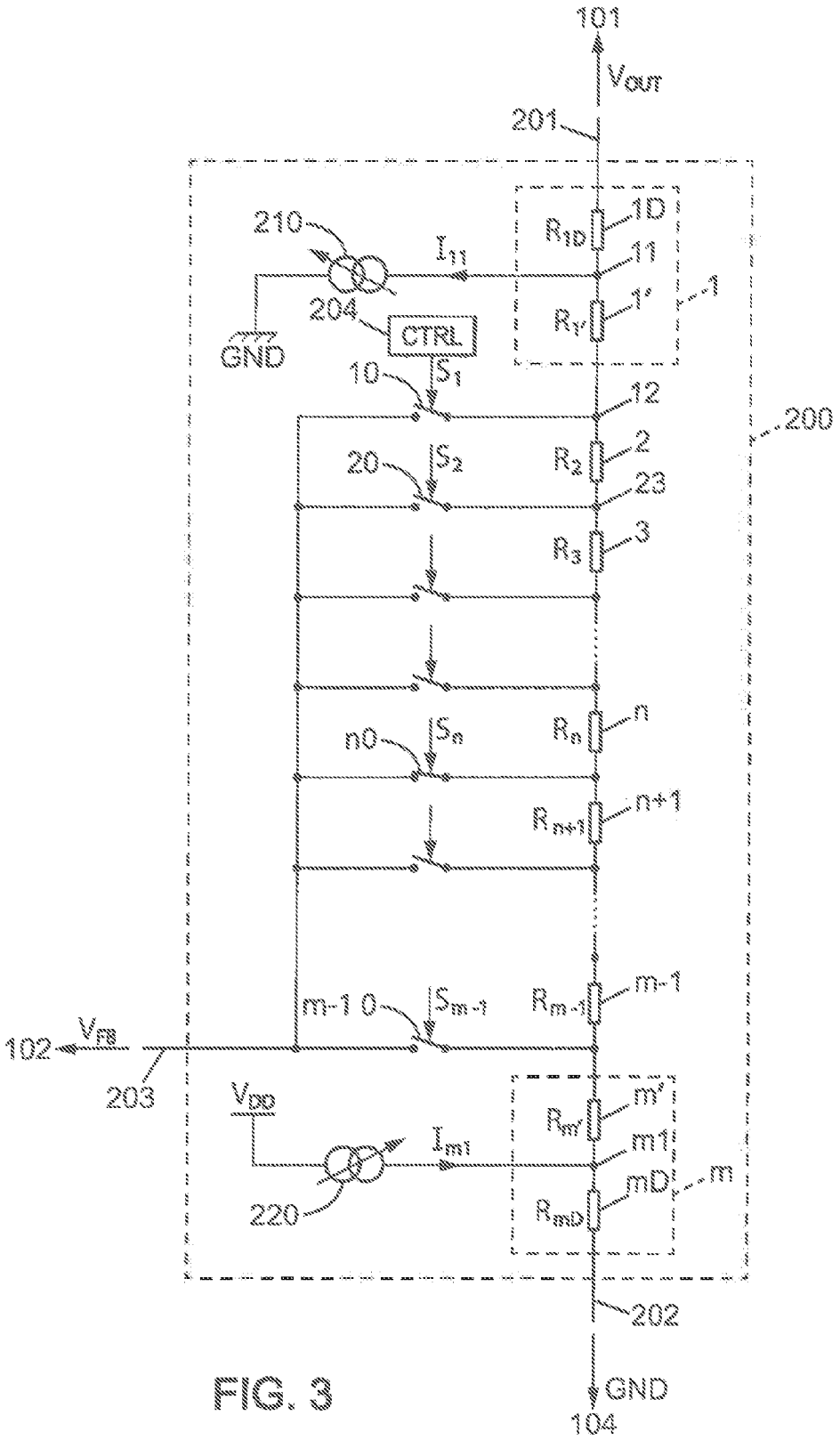
FIG. 3 is a circuit diagram of a feedback network according to an embodiment of this disclosure which is also suitable for the LDO regulator of FIG. 1.

Reference is made to FIG. 3 showing a modification of the circuit diagram of FIG. 2. Therefore, common elements are not repeated, and description is focussed on the new features. In particular, like references and reference numbers which are displayed in these figures have identical meanings. Thus, the feedback network 200 of FIG. 3 is to be inserted in the LDO regulator of FIG. 1, at the location of the frame 200 drawn in broken line.

Resistance sets are involved because the corresponding resistance values may be produced by parallel and/or serially coupling several resistance units. The resistances may be of the same type, for example doped semiconducting material or diffusion-modified material.

The resistance set 1 has been replaced with two series-connected resistance subsets 1D and 1', with respective resistance values $R_{1D}$ and $R_{1'}$. An intermediate node 11 is thus added in the chain, between the resistance subsets 1D and 1'. In addition, a programmable current generator 210 is coupled to the intermediate node 11, so as to extract the current $I_{11}$ from the chain of resistance sets, between the resistance subsets 1D and 1'. The programmable current generator 210 may be arranged so that the current $I_{11}$ is positive when the power supply voltage $V_{DD}$ is also positive with respect to the power reference terminal 104. Then, the output voltage of the LDO regulator is:

$$V_{OUT}=G\cdot V_{REF}+R_{1D}\cdot I_{11} \quad (2)$$

Figure 4:
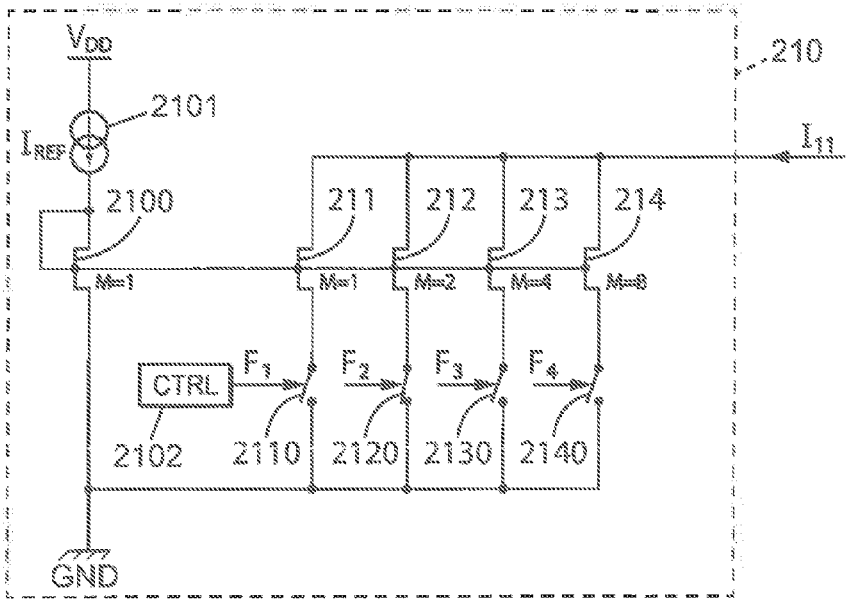
FIGS. 4 and 5 are circuit diagrams of two digitally-controlled current generators which may be used in the embodiment of FIG. 3.

The programmable current generator 210 may be itself comprised of a digital-to-analog converter and a fixed-current generator 2101, which will now be described with reference to FIG. 4. $I_{REF}$ is the fixed current produced by the generator 2101 within the branch which contains the nMOS transistor 2100. This transistor 2100 forms the entry branch of several mirroring assemblies with respective ratios 1, 2, 4, . . . . The digital-to-analog converter represented in FIG. 4 is a four-bit converter for example purpose, but it may involve other bit numbers. Reference numbers 211 to 214 denote other nMOS transistors forming the output branches of the mirroring assemblies, which are coupled to one another in parallel with respect to the entry branch shared. The M-value indicated for each transistor is the ratio of its gate width with respect to that of transistor 2100. Reference numbers 2110, 2120, 2130 and 2140 denote switches which are controlled by the additional controller 2102, which is internal to the current generator 210. $F_i$, with i being an integer from 1 to 4, is a binary signal intended to control the switch 2110 into the connecting state or the isolating state. Thus, the current $I_{11}$ which is extracted from the chain by the generator 210 may have the values $I_{REF}\times<F_1:F_4>$, where $<F_1:F_4>$ is the four-bit word dedicated to control the current value output by the generator 210. Thus sixteen values are available for the current $I_{11}$ with a constant increment.

Figure 6:
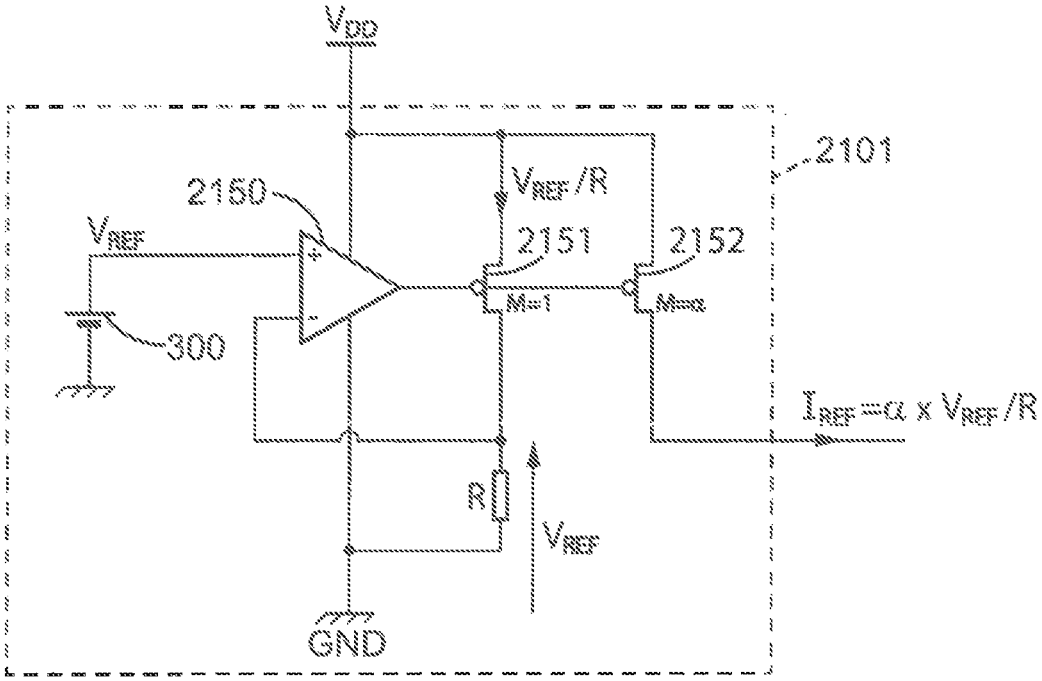
FIG. 6 is a circuit diagram of a fixed-current generator which may be used within the digitally-controlled current generator of FIG. 4.

FIG. 6 represents a possible structure for the fixed-current generator 2101. $V_{REF}$ denotes again a reference voltage value which may be the same as that used for the non-inverting input terminal of the differential amplifier. Thus, the voltage supply 300 may be coupled in parallel to the differential amplifier 2150 and to the differential amplifier of FIG. 1. The term a is the gate width ratio between the pMOS transistors 2151 and 2152, which are regulated in parallel to each other by the differential amplifier 2150. The resistance R may helpfully be of the same manufacturing type as the resistance sets 1, 2, . . . , m of the chain.

For the particular embodiment described here in detail, the chain of the resistance sets corresponds to m=17. Then, the controller may be addressed with another four-bit word for producing the control signals $S_1$ to $S_{16}$ intended for the switches. The following table gathers the numeral values which have been used:

| $R_{1D}$ | $R_{1'}$ | $R_2$ | $R_3$ | $R_4$ | $R_5$ | $R_6$ | $R_7$ | $R_8$ | $R_9$ |
|---|---|---|---|---|---|---|---|---|---|
| 125 | 104.5 | 46 | 38 | 31.5 | 26.7 | 23 | 19.82 | 17.5 | 15.4 |
| $R_{10}$ | $R_{11}$ | $R_{12}$ | $R_{13}$ | $R_{14}$ | $R_{15}$ | $R_{16}$ | $R_{17'}$ | $R_{17D}$ | $V_{REF}$ |
| 13.5 | 12.2 | 11 | 9.9 | 9 | 8.3 | 7.5 | 111.4 | 62.5 | 0.6 |

In this table, the unit of resistance is the kΩ (kilo-ohm) and the unit for $V_{REF}$ is the V (volt). Generally, it may not be helpful to split the last resistance set $R_m$ into two resistance subsets $R_{m'}$ and $R_{mD}$ coupled in series. Thus, both resistance subsets $R_{17'}$ and $R_{17D}$ may be replaced by a single resistance set of 173.9 kΩ in the particular embodiment reported. With these values and α and R of the fixed-current source 2101 suitably selected, varying the control four-bit word which is transmitted to the controller leads the LDO output voltage $V_{OUT}$ to vary from 0.9 V to 2.4 V with a constant increment of 0.1 V. This corresponds to the first term in the second member of equation (2) above. The second term $R_{1D}\cdot I_{11}$ equals j·6.25 mV (millivolt) where j is the integer corresponding to the binary value of the four-bit word $<F_1:F_4>$. Given that 16×6.25 mV equals 0.1 V, the voltage increment involved by the controller appears as a coarse increment, whereas the voltage increment involved by the programmable current generator appears as a fine increment, which is a divider of the coarse increment.

Thus, the implementation of the programmable current generator allows a tuning of the LDO output voltage $V_{OUT}$ with 16×16=256 available values. The same $V_{OUT}$ value number obtained by using an appropriate chain of resistance sets 1, 2, . . . , m−1, m may have instead involved m−1=256 switches referenced as 10, 20, . . . , Y and also the controller 204 being an eight-bit controller. So, the teachings of this disclosure allow a reduction of the number of chain switches from 256 to 16, plus the four switches internal to the programmable current generator 210. The eight-bit controller is also replaced by two four-bit controllers, which is simpler. This leads to a reduction in the area occupied by the feedback network 200 from 70% to 20% of the control loop area.

FIG. 3 also illustrates an optional feature, which involves implementing another programmable current generator 220 in combination with the splitting of the resistance set $R_m$ into the subsets $R_{m'}$ and $R_{mD}$. Then, the LDO output voltage value is:

$$V_{OUT}=G\cdot V_{REF}+R_{1D}\cdot I_{11}-R_{mD}\cdot(G-1)\cdot I_{m1} \quad (3)$$

where $I_{m1}$ is the programmable current which is injected by the current generator 220 into the chain of resistance sets at the node m1, between the resistance subsets $R_{m'}$ and $R_{mD}$. Formula 3 may be re-written in the following way:

$$V_{OUT}=G\cdot(V_{REF}-R_{mD}\cdot I_{mD})+(R_{1D}\cdot I_{11}+R_{mD}\cdot I_{m1}) \quad (3')$$

Thus, the programmable current generator 220 produces a trimming function by varying the voltage value which is effective for the application of the division factor G of the feedback network 200. The current generator 220 may be designed so that the current $I_{m1}$ flows towards the intermediate node m1 when the power supply voltage $V_{DD}$ is positive. Thus, the trimming of the $V_{OUT}$-value which is enabled by the current generator 220 is opposite in sign to the $V_{OUT}$-tuning provided by the current generator 210. Easier overall adjustment of the LDO output voltage is thus obtained.

Figure 5:
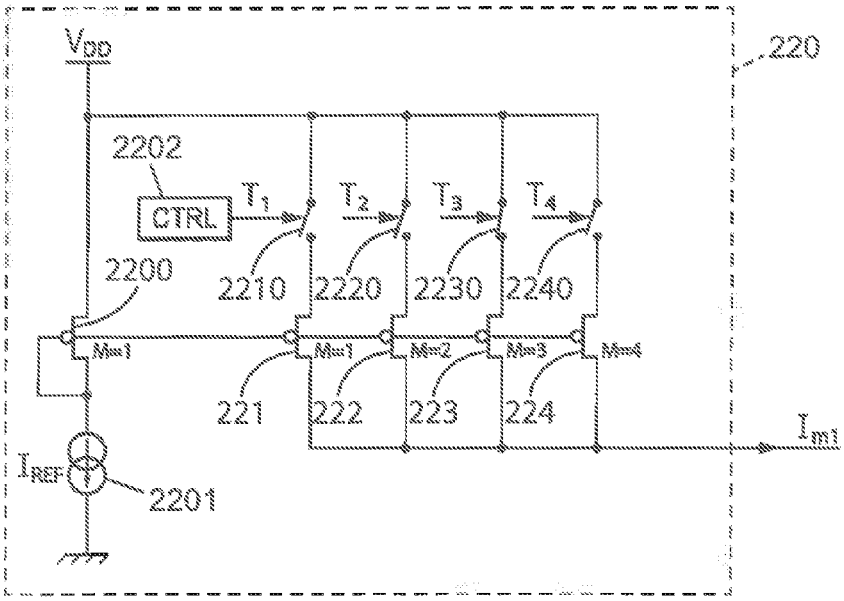

FIG. 5 corresponds to FIG. 4 for the current generator 220 with the current polarization described above, and for the particular example of 16 available $I_{m1}$-values. Its composition is thus symmetrical to that of the current generator, with similar operation. The following reference numbers are used to denote the following elements: 2201 a fixed-current generator; 2200 a pMOS transistor for the entrance branch of the mirroring assemblies; 221-224 pMOS transistors for the output branches of the mirroring assemblies; 2210-2240 switches of the output branches of the mirroring assemblies; 2202 a controller of the current generator 220; and $T_1$-$T_4$ control signals for the switches 2210-2240.

Figure 7:
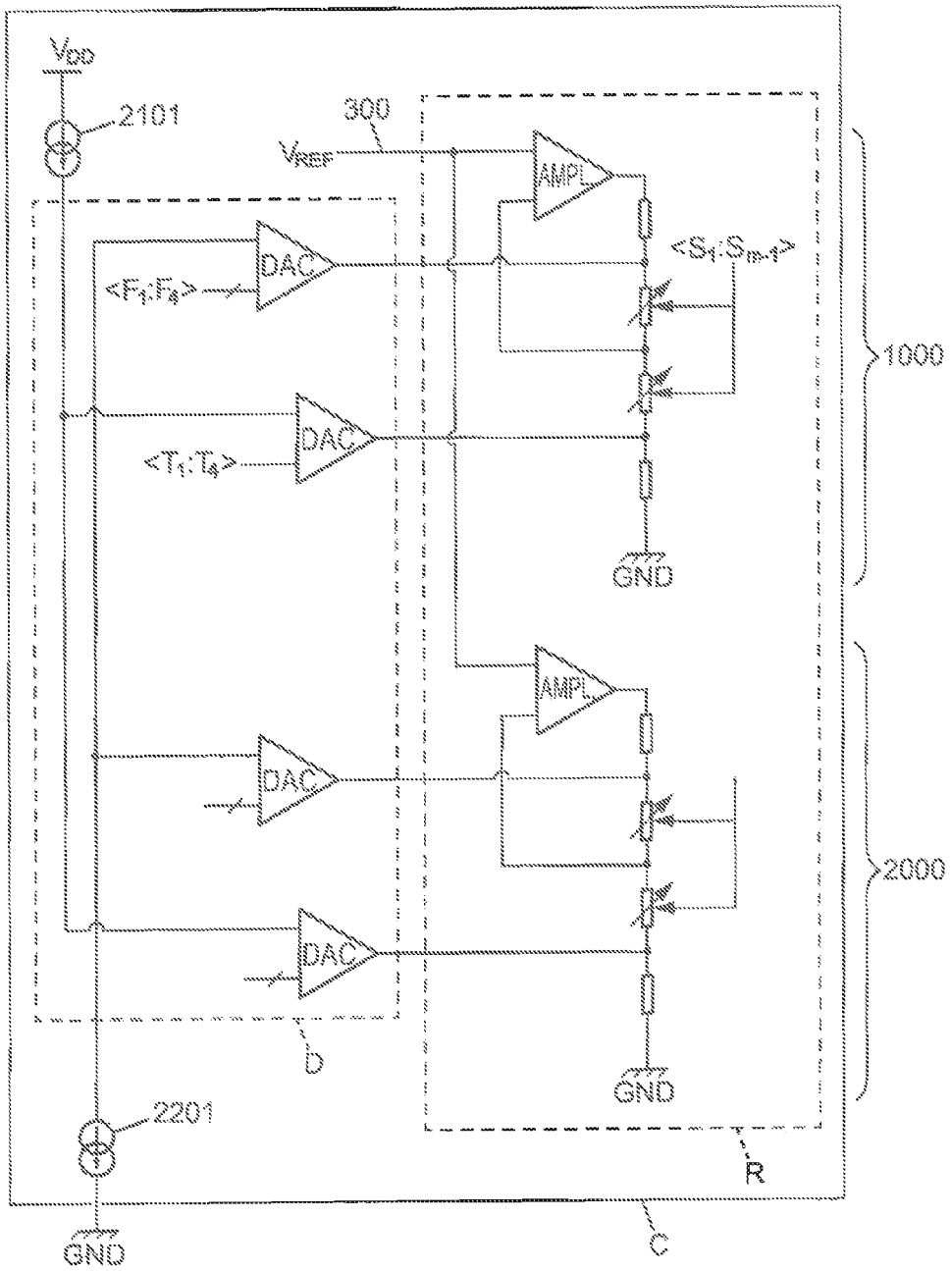
FIG. 7 is a schematic representation of an arrangement for an integrated circuit chip according to this disclosure.

FIG. 7 illustrates a possible arrangement of a chip C forming an integrated circuit which includes several LDO regulators, for example two LDO regulators 1000 and 2000. The LDO regulators of the chip C may be as described above. In FIG. 7, DAC denotes a digital-to-analog converter according to the implementations of FIGS. 4 and 5, and AMPL denotes a differential amplifier according to the implementation of FIG. 1. An arrangement of the chip C includes gathering the DACs in a portion D of the chip C, whereas the remaining circuit parts are contained in a remaining portion R of the chip C. In particular, the remaining chip portion R contains the chains of the resistance sets of the feedback networks, and also the differential amplifiers of the LDO regulators. Such a chip arrangement is advantageous because adding further DACs for completing the LDO feedback networks may not involve re-designing the layout of the chip remaining portion R, thereby allowing time-saving during implementation. In particular, an already existing chip design which includes one or several feedback networks according to FIG. 2 can be completed by adding fine-tuning DACs and trimming DACs within the chip portion D, without modifying the layout of the remaining portion R. Thus, the designs herein can be implemented easily while starting from an existing chip arrangement. In addition, the current generators 2101 and 2201 as well as the reference voltage supply 300 may be common to part or all of the plurality of LDO regulators.

The invention claimed is:

1. A circuit, comprising:

a chain of resistance sets coupled in series and having a first end terminal and a second end terminal;

respective nodes coupled between successive ones of the resistance sets;

a feedback terminal;

a set of switches capable of electrically coupling a given one of the respective nodes to the feedback terminal;

a first resistance set of the chain adjacent the first end terminal comprising two resistance subsets coupled in series at an intermediate node between the two resistance subsets; and a first programmable current generator having a current output terminal directly connected to the intermediate node between the two resistance subsets and being configured to produce a controlled value of current at the current output terminal flowing into or out of the intermediate node.

2. The circuit of claim 1, wherein the resistance sets have resistance values such that a voltage at the first end terminal varies with a constant increment upon variation of the given one of the respective nodes.

3. The circuit of claim 2, wherein the first programmable current generator is configured such that the current at the current output terminal of the first programmable current generator is digitally controlled.

4. The circuit of claim 2, wherein a last resistance set of the chain adjacent the second end terminal comprises two other resistance subsets coupled in series at an intermediate node between the two other resistance subsets; and wherein the feedback network further comprises a second programmable current generator having a current output terminal directly connected to the intermediate node between the two other resistance subsets of the last resistance set of the chain and being configured to produce a controlled value of a current at the current output terminal of the second programmable current generator flowing into or out of the intermediate node between the two other resistance subsets.

5. The circuit of claim 4, wherein the second programmable current generator is configured such that the current at the current output terminal of the second programmable current generator is digitally controlled.

6. The circuit of claim 4, wherein the first and second programmable current generators are configured such that the current at the current output terminal of the first programmable current generator is sunk from the intermediate node coupled between the two resistance subsets, and the current at the current output terminal of the second programmable current generator is sourced into the intermediate node coupled between the two other resistance subsets.

7. The circuit of claim 4, wherein the first and second programmable current generators are configured such that the current at the current output terminal of the second programmable current generator is sunk from the intermediate node coupled between the two other resistance subsets, and the current at the current output terminal of the first programmable current generator is sourced to the intermediate node coupled between the two resistance subsets.

8. The circuit of claim 1, further comprising a differential amplifier having an inverting input terminal coupled to the feedback terminal, a power reference terminal coupled to the second end terminal, and an output terminal coupled to the first end terminal.

9. A circuit, comprising:

a differential amplifier having an inverting input terminal, a power reference terminal, and output terminal;

a feedback network comprising:

a chain of resistance sets coupled in series and having a first end terminal coupled to the output terminal of the differential amplifier and a second end terminal coupled to the power reference terminal of the differential amplifier, respective nodes coupled between successive ones of the resistance sets, a feedback terminal coupled to the inverting input terminal of the differential amplifier, a set of switches configured to electrically couple a given one of the respective nodes to the feedback terminal, a controller configured to control the set of switches so as to electrically couple the given one of the respective nodes to the feedback terminal, a first resistance set of the chain adjacent the first end terminal comprising two resistance subsets coupled in series at an intermediate node between the two resistance subsets, and a first programmable current generator having a current output directly connected to the intermediate node between the two resistance subsets and being configured to produce a controlled value of current at the current output terminal flowing into or out of the intermediate node.

10. The circuit of claim 9, wherein the resistance sets have resistance values such that a voltage at the first end terminal varies with a constant increment upon variation of the given one of the respective nodes.

11. The circuit of claim 9, wherein the first programmable current generator is configured such that the current at the current output terminal of the first programmable current generator is digitally controlled.

12. The circuit of claim 9, wherein a last resistance set of the chain adjacent the second end terminal comprises two other resistance subsets coupled in series at an intermediate node between the two other resistance subsets; and wherein the feedback network further comprises a second programmable current generator having a current output terminal directly connected to the intermediate node between the two other resistance subsets of the last resistance set of the chain and being configured to produce a controlled value of a current at the current output terminal of the second programmable current generator flowing into or out of the intermediate node between the two other resistance subsets.

13. The circuit of claim 12, wherein the second programmable current generator is configured such that the current at the current output terminal of the second programmable current generator is digitally controlled.

14. The circuit of claim 12, wherein the first and second programmable current generators are configured such that the current at the current output terminal of the first programmable current generator is sunk from the intermediate node coupled between the two resistance subsets, and the current at the current output terminal of the second programmable current generator is sourced into the intermediate node coupled between the two other resistance subsets.

15. The circuit of claim 12, wherein the first and second programmable current generators are configured such that the current at the current output terminal of the second programmable current generator is sunk from the intermediate node coupled between the two other resistance subsets, and the current at the current output terminal of the first programmable current generator is sourced to the intermediate node coupled between the two resistance subsets.

16. The circuit of claim 9, further comprising a reference voltage supply; wherein the differential amplifier has a non-inverting input terminal coupled to the reference voltage supply.

17. The circuit of claim 16, wherein the first programmable current generator is configured such that a maximum current value output at the output terminal of the first programmable current generator, multiplied by a value of a resistance subset coupled between the first end terminal and the intermediate node, is less than a minimum voltage increment obtained for the output terminal of the differential amplifier when varying the given one of the respective nodes.

18. The circuit of claim 17, wherein the resistance sets have resistance values such that a voltage at the first end terminal varies with a constant increment upon variation of the given one of the respective nodes; and wherein the first current generator is configured such that varying a control thereof causes a voltage of the output terminal of the differential amplifier to vary with a constant secondary increment, the constant secondary increment being equal in absolute value to the constant increment divided by a number of output current values available for the first programmable current generator.

19. An integrated circuit comprising:

a first circuit comprising:

a first differential amplifier having an inverting input terminal, a power reference terminal, and output terminal, a first feedback network comprising:

a chain of resistance sets coupled in series and having a first terminal coupled to the output terminal of the first differential amplifier and a second end terminal coupled to the power reference terminal of the first differential amplifier, respective nodes coupled between successive ones of the resistance sets, a feedback terminal coupled to the inverting input terminal of the first differential amplifier, a set of switches capable of electrically coupling a given node to the feedback terminal, a controller configured to control the set of switches so as to electrically couple the given node to the feedback terminal, a first resistance set of the chain adjacent the first end terminal comprising two resistance subsets coupled in series, with an intermediate node coupled between the two resistance subsets, and a first programmable current generator having a current output terminal coupled to the intermediate node and being configured to produce a controlled value of current flowing at the current output terminal, and a second circuit comprising:

a second differential amplifier having an inverting input terminal, a power reference terminal, and output terminal, a second feedback network comprising:

a chain of resistance sets coupled in series and having a first terminal coupled to the output terminal of the second differential amplifier and a second end terminal coupled to the power reference terminal of the second differential amplifier, respective nodes coupled between successive ones of the resistance sets, a feedback terminal coupled to the inverting input terminal of the second differential amplifier, a set of switches capable of electrically coupling a given node to the feedback terminal, a controller configured to control the set of switches so as to electrically couple the given node to the feedback terminal, a first resistance set of the chain adjacent the first end terminal comprising two resistance subsets coupled in series, with an intermediate node coupled between the two resistance subsets, and a first programmable current generator having a current output coupled to the intermediate node and being configured to produce a controlled value of current flowing at the current output terminal;

wherein the first programmable current generator of the first circuit and the first programmable current generator of the second circuit each comprise respective digital-to-analog converters, the digital-to-analog converter of the first programmable current generator being formed adjacent the digital-to-analog converter of the second programmable current generator;

wherein the chain of the resistance sets of the first circuit and the chain of the resistance sets of the second circuit are formed spaced apart from the digital-to-analog converter of the first programmable current generator and the digital-to-analog converter of the second programmable current generator;

wherein the first differential amplifier of the first circuit and the second differential amplifier of the second circuit are formed spaced apart from the digital-to-analog converter of the first programmable current generator and the digital-to-analog converter of the second programmable current generator.

20. The integrated circuit of claim 19, further comprising a reference voltage supply; wherein the first differential amplifier of the first circuit has a non-inverting input terminal coupled to the reference voltage supply; and wherein the second differential amplifier of the second circuit has a non-inverting input terminal coupled to the reference voltage supply.

21. The integrated circuit of claim 20, wherein, for the first circuit, the first programmable current generator is configured such that a maximum current value output at the output terminal of the first programmable current generator, multiplied by a value of a resistance subset coupled between the first end terminal and the intermediate node is less than a minimum voltage increment obtained for the output terminal of the first differential amplifier when varying the given node; and wherein, for the second circuit, the first programmable current generator is configured such that a maximum current value output at the output terminal of the first programmable current generator, multiplied by a value of a resistance subset coupled between the first end terminal and the intermediate node is less than a minimum voltage increment obtained for the output terminal of the second differential amplifier when varying the given node.

22. A circuit, comprising:

a differential amplifier having a first input, a second input and an output;

a string of series connected resistors coupled between a first node and a second node, wherein each adjacent pair of resistors in said string are connected an intermediate node;

a switching circuit configured to selectively connect a selected intermediate node to the second input of the differential amplifier;

a first resistor and a second resistor connected in series at a first current node, said first and second resistors coupled between the output of the differential amplifier and the first node of the string of series connected resistors; and a first programmable current generator having a current output terminal directly connected to the first current node and being configured to produce a controlled value of current at the current output terminal flowing into or out of the first current node.

23. The circuit of claim 22, further comprising:

a third resistor and a fourth resistor connected in series at a second current node, said third and fourth resistors coupled between the second node of the string of series connected resistors and a reference node; and a second programmable current generator having a current output terminal directly connected to the second current node and being configured to produce a controlled value of current at the current output terminal flowing into or out of the second current node.

* * * * *